United States Patent [19]

Getchell et al.

[11] 3,982,410

[45] Sept. 28, 1976

[54] APPARATUS FOR THE CONTINUOUS TREATMENT OF AN ADVANCING WEB

[75] Inventors: Nelson F. Getchell, Great Falls, Va.; Norman R. S. Hollies, Bethesda; Samuel S. Stanton, Chevy Chase, both of Md.

[73] Assignee: Cotton Incorporated, New York, N.Y.

[22] Filed: May 20, 1974

[21] Appl. No.: 471,692

Related U.S. Application Data

[63] Continuation-in-part of Ser. No. 329,145, Feb. 2, 1973, Pat. No. 3,908,408.

[52] U.S. Cl. ..... 68/5 E

[51] Int. Cl.[2] ..... D06B 3/10

[58] Field of Search ..... 68/5 D, 5 E, DIG. 1, 68/19, 19.1, 181 R; 8/149.2, 151; 118/68

[56] References Cited

UNITED STATES PATENTS

| | | | |
|---|---|---|---|
| 3,388,965 | 6/1968 | Garrett | 8/149.3 |
| 3,502,456 | 3/1970 | Fetner | 118/68 |

*Primary Examiner*—Harry N. Haroian
*Assistant Examiner*—L. Footland
*Attorney, Agent, or Firm*—Burns, Doane, Swecker & Mathis

[57] ABSTRACT

An apparatus for the continuous treatment of an advancing web such as a cotton fabric with one or more reactive gases comprises one or more reaction chambers, each including fluid dicharge means for directing a treating gas onto the web in the chamber and evacuation means disposed on both ends of the chamber to prevent both the fluid from escaping from the chamber and the fluid outside the chamber from entering the chamber. Heating means adapted to heat the continuously advancing web of fabric material may also be provided, if desired.

Such an apparatus may be used for the application of gases such as ammonia to a fabric impregnated with monomeric tris (hydroxymethyl) phosphine to form on the fabric a polymerized phosphorus-containing material and to impart flameproofing properties thereto. The apparatus can also be used to apply gases such as formaldehyde or sulfur dioxide or both to a cellulose fiber-containing fabric at an elevated temperature and in the presence of controlled amounts of moisture. In this manner, a previously applied N-methylol precondensate can be "wet fixed" in th fabric, thus making it possible to improve the wrinkle resistance and other shape-holdng properties of the fabric while preserving good fabric strength after an eventual dry cure. Such an apparatus can also be used directly to impart the desired shape-holding properties to the fabric, e.g., by crosslinking cotton by means of an acid-catalyzed formaldehyde reaction in the described apparatus.

5 Claims, 6 Drawing Figures

APPARATUS FOR THE CONTINUOUS TREATMENT OF AN ADVANCING WEB

CROSS REFERENCE TO RELATED APPLICATIONS

This application is a continuation-in-part application of our earlier filed, copending application Ser. No. 329,145, filed Feb. 2,1973, now U.S. Pat. No. 3,908,408.

BACKGROUND OF THE INVENTION

Various processes have been developed for altering the physical properties of a fabric by applying various agents to the fabric, usually during a finishing process. For example, it is well-known to impart durable wrinkle resistance to cellulose fiber-containing fabrics such as cotton by impregnation of a continuous length of fabric with an aqueous solution of a suitable low molecular weight thermosetting resinous precondensate or cellulose crosslinking agent of a small enough molecular size to penetrate the cellulose fiber structure, usually with an appropriate catalyst, and eventual curing of the impregnated fabric. Such treatments have been effective in improving the shape-holding properties of cotton fabrics and have resulted in a greatly increased demand for durable press cotton fabrics because these combine the traditional comfort, washability and economy of the native fibers with the easy care properties desired in today's textile market. To facilitate garment manufacture, the cure of such resin-treated fabrics is delayed until after the treated fabric is cut and sewn to produce the desired finished garment and after such garment is given the desired shape by pressing.

A particularly promising approach to the production of easy-care, durable press garments has involved the wet fixation of resin- or polymer- forming creaseproofing agents, such as formaldehyde-melamine precondensates, as disclosed, for example, in U.S. Pat. No. 3,138,802. In this type of process, fiber system such as a cotton fabric is protected against excessive strength loss and presensitized for durable press processing by fixation of a suitable polymer-former and creaseproofing agent within the fibers while they are wet and swollen but without greatly altering the dry crease recovery angle or durable properties of the fiber system. The latter properties are only imparted in the desired degree during a subsequent dry cure. Such a process accordingly permits ready creasing or other distinct shaping of the fiber system during apparel manufacture or the like subsequent to the wet fixation step and prior to the delayed dry cure. However, wet fixation processes heretofore known have usually required neutralization and wash-off of the strongly acid wet fixation catalyst subsequent to the wet fixing step, to be followed by drying and then recatalyzation and redrying prior to the actual cure, thus requiring additional processing time and effort.

Other promising approaches to the production of easy-care, durable press garments have involved exposing a condition cotton fabric to formaldehyde and gaseous sulfur dioxide and heating the fabric under controlled moisture conditions, as disclosed, for example, in U.S. Pat. No. 3,706,526, and in copending application Ser. No. 237,056 of Swidler et al, filed Mar. 22, 1972, assigned to the assignee of the present application. These processes result directly in a cured fabric.

A superior durable press process is disclosed in U.S. Pat. No. 3,642,428. This process includes applying to a cellulose fiber-containing fabric a solution containing a polymer former such as a melamine-formaldehyde or urea-formaldehyde precondensate and a latent curing catalyst. Subsequently, the fabric while in a water swollen state is exposed at an elevated temperature in the presence of formaldehyde to a gas which is a strong acid (e.g., acetic acid, formic acid, hydrogen chloride) or capable of forming a strong acid by reaction with formaldehyde (as in the case of sulfur dioxide). The resulting fabric, which now contains the polymer former wet fixed therein, is dried to form a fabric which contains the wet fixed resin. This dry fabric may then be sewn to form a garment which may have creases hot pressed into it and the garment may finally be cured in the presence of a latent curing catalyst to impart durable press properties to it. As an alternative, the fabric containing the wet fixed resin and latent catalyst may be cured and thus have durable press properties imparted to it before it is made into a final product such as bed linen, if desired, a garment.

Treatment of the fabric with formaldehyde and sulfur dioxide must be carried out under carefully controlled conditions of temperature and humidity in order to achieve optimum results as the crosslinking reaction based on formaldehyde and sulfur dioxide is self-limiting in that removal of water from the system causes decomposition of the strong sulfonic acid which serves as a catalyst for this reaction. Another important consideration in a process of this type is providing suitable apparatus which prevents leakage of hazardous or noxious reactants, such as formaldehyde and sulfur dioxide, out of the apparatus. Both formaldehyde and sulfur dioxide are noxious and pungent, and leakage of these materials into the atmosphere around the processing apparatus is objectionable from the point of view of safety or industrial hygiene.

Various processes are also known to impart flame retardancy to cellulosic fiber-containing fabrics. For example, the fabric may be padded with a suitable flame retardant precursor compound and then contacted with ammonia gas to deposit on the fabric a polymerized phosphorus-containing material. Ammonia gas, however, is highly toxic and forms an explosive mixture with air at moderate concentrations of ammonia. Leakage of ammonia into the atmosphere around the processing apparatus is therefore objectionable and dangerous.

OBJECTS AND SUMMARY OF THE INVENTION

Accordingly, it is an object of this invention to provide a process and apparatus for efficiently and effectively treating a continuously advancing web of material with a noxious or hazardous fluid.

Another object of the invention is to provide process and apparatus for treating a continuously advancing web of material with a reactive gas under controlled conditions of temperature, gas concentration and humidity.

A further object of the invention is to provide a process and apparatus for treating a continuously advancing web of material with a noxious gas without objectionable leakage of the gas into the surrounding atmosphere or leakage of the atmosphere into the treating chamber.

A specific object of this invention is to provide a process and apparatus for the application of ammonia gas to form a flame retardant material in a cotton-containing fabric to provide a flame retardant fabric which process and apparatus substantially prevent leakage of ammonia into adjacent areas.

These and other objects of the invention will become more clearly apparent from the following description.

In accordance with one aspect of the invention, there is provided an apparatus for treating a continuous advancing web of material with a fluid comprising: sleeve-like chamber means having an extrance opening and exit opening; a pair of partitions in said chamber means, one of said partitions being adjacent said entrance opening and the other of said partitions being adjacent said exit opening, said partitions each having an opening aligned with said entrance and exit openings; conduit means for conducting fluid into said chamber means between said partitions, said conduit means including fluid discharge means on at least one side of the axis of said aligned opening, said sleeve-like chamber and said fluid discharge means being adapted to provide penetration of the fluid throughout the web during passage of the web in the chamber between said partitions; and evacuation means for withdrawing fluid from said chamber means between said entrance opening and said one partition, and from between said exit opening and said other partition.

In accordance with another aspect of the invention, there is provided a fluid treatment apparatus comprising: enclosure means; reaction chamber means in said enclosure means; fluid spray means disposed in said reaction chamber means; and means for conducting a continuous web of material into said enclosure and through said reaction chamber means and subsequently out of said enclosure.

In accordance with still another aspect of the invention, there is provided a process for treating a continuously advancing fabric web with a reactive fluid which comprises: continuously advancing said fabric into an enclosure; continuously advancing said fabric into a reaction chamber disposed within said enclosure where fluid is applied to at least one side of the fabric to penetrate throughout the fabric as it passes through the reaction chamber without substantial leakage of the fluid from the reaction chamber into the enclosure, the said fluid reacting with the fabric or materials contained therein; and continuously advancing said fabric from said enclosure.

By carrying out contact of the fabric with treatment gases within the reaction chamber of the present invention, the fabric may be treated under controlled conditions without significant leakage of hazardous or noxious gases into the interior of the enclosure to pose a safety hazard or interfere with intermediate processing steps which are being performed within the same enclosure.

These and other aspects, advantages and embodiments of the present invention will become more clearly apparent from the following detailed description.

DESCRIPTION OF THE DRAWINGS

A preferred embodiment of the invention is illustrated in the accompanying drawings in which.

DESCRIPTION OF THE PREFERRED EMBODIMENTS

The Apparatus

Figure 1:
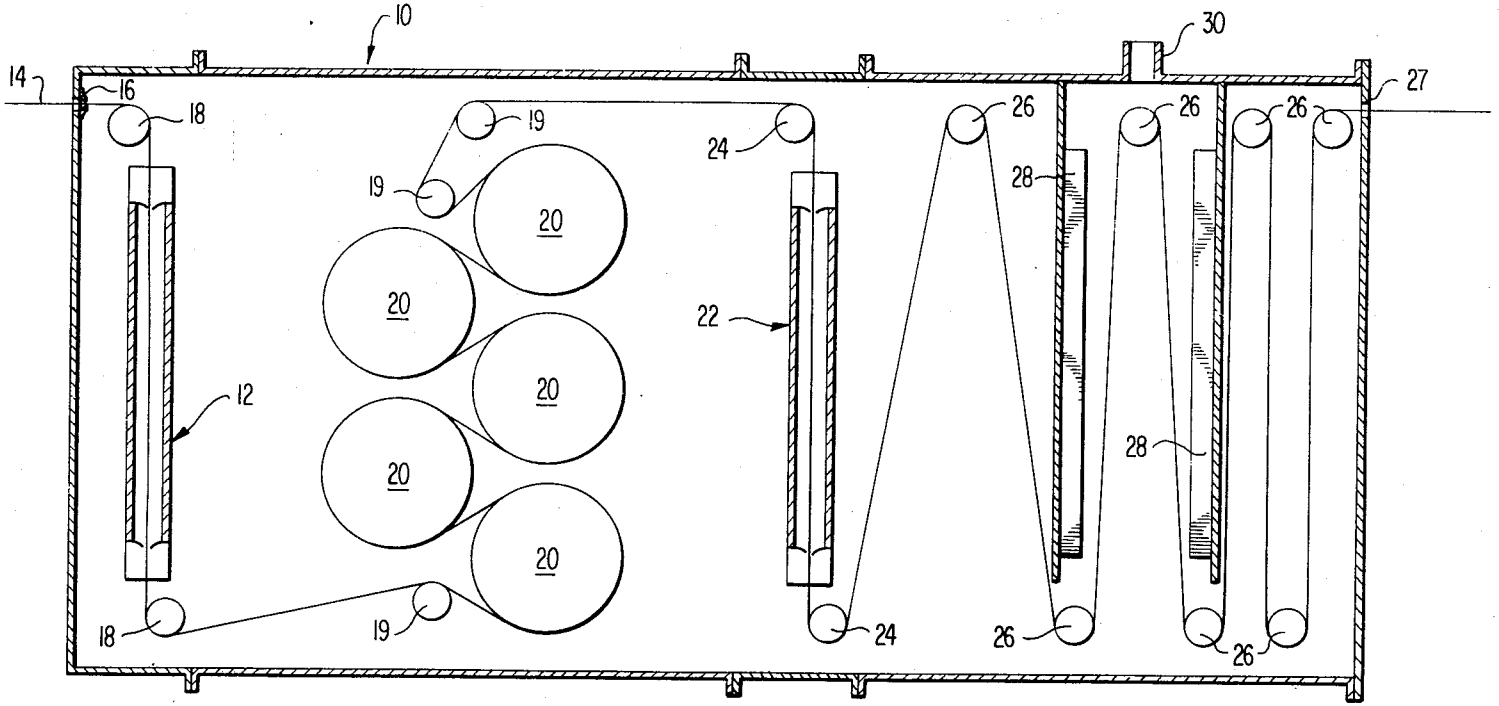
FIG. 1 is a side elevational view, partially schematic, of the fluid treatment apparatus of the invention.

A preferred embodiment of the fluid treatment apparatus of this invention is illustrated schematically in FIG. 1. The apparatus includes an enclosure 10 which is in the form of a large box. The top and bottom walls, side walls, and end walls of the enclosure 10 may be jacketed in order to minimize heat conduction through the walls. The web or fabric enters the enclosure 10 through a horizontal slot 16 which extends across at least a portion of the end wall of the enclosure 10. Preferably, inward curved guide members, as indicated schematically at 16, are positioned in close proximity to the upper and lower surfaces of the fabric to minimize heat loss from the interior of the enclosure.

A reaction chamber 12 is mounted in the interior of the enclosure adjacent one end (preferably the fabric entry end). The reaction chamber 12 has openings at the top and bottom to allow the fabric 14 to pass through the chamber 12. Reaction chamber 12 is suitably provided with the fluid inlet and outlet means, as more fully explained hereinbelow, to provide contact between the fluid and the fabric within the reaction chamber 12. The enclosure 10 further contains guide rolls 18 disposed at the top and the bottom of the reaction chamber 12 which align the fabric 14 with a center plane passing vertically through the reaction chamber 12.

From the reaction chamber 12, the fabric is guided by suitably disposed guide rolls 19 over a plurality of heated rotary drums 20. The drums 20 are of conventional construction and may be provided with suitable means for heating the surface of the drums to temperatures in the range of between 80° and 180°C. The size and number of the drums 20 as well as the speed of the fabric about the drums may be adjusted such that the fabric is heated to a desired temperature as the fabric 14 exits from the drums 20.

A second reaction chamber 22, which is substantially identical in construction to the reaction chamber 12, may be mounted vertically within the enclosure 10. Guide rolls 24 are provided in enclosure 10 for guiding the fabric 14 through the reaction chamber 22 in the same manner as the guide rolls 18.

The enclosure 10 also may include means to provide, if desired, an area for the fabric to be held for a desired time prior to leaving the enclosure 10. For example, a plurality of guide rolls 26 may be arranged along the top and the bottom of the enclosure and the fabric 14 passed over these guide rolls to allow exposure of the fabric to the conditions in the enclosure for a predetermined period of time as the fabric advances continuously. Preferably, one or more heating means 28 extending across the width of the enclosure 10 on opposite side of vertical runs of the fabric may be provided. Other suitable means to provide a desired temperature or moisture content, such as steam jets or the like, in the enclosure may also be provided. Gas may be withdrawn continuously through one or more conduits 30 along the top of the enclosure 10. This controlled exhaust arrangement permits keeping the system at a predetermined negative pressure relative to the exterior pressure. The fabric 14 may be removed from the enclosure 10 through horizontal slot 27 for further processing.

Figure 3:
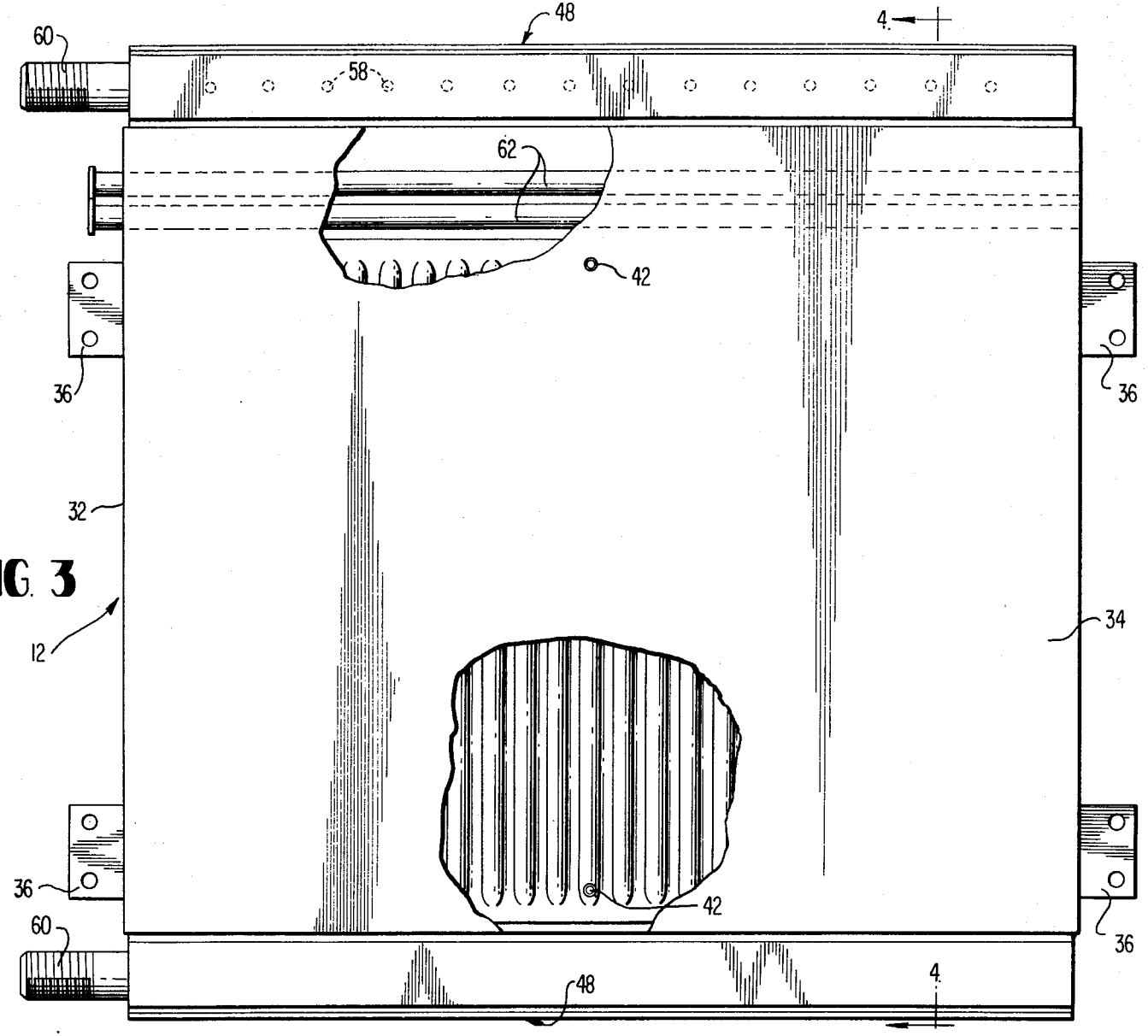
FIG. 3 is a front elevational view of the reaction chamber of FIG. 2.
Figure 2:
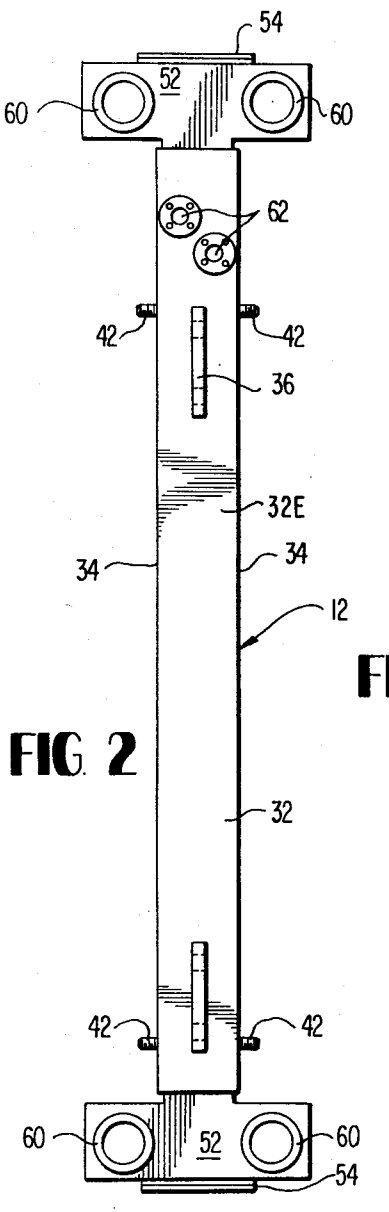
FIG. 2 is a side elevational view of a reaction chamber in accordance with this invention.
Figure 4:
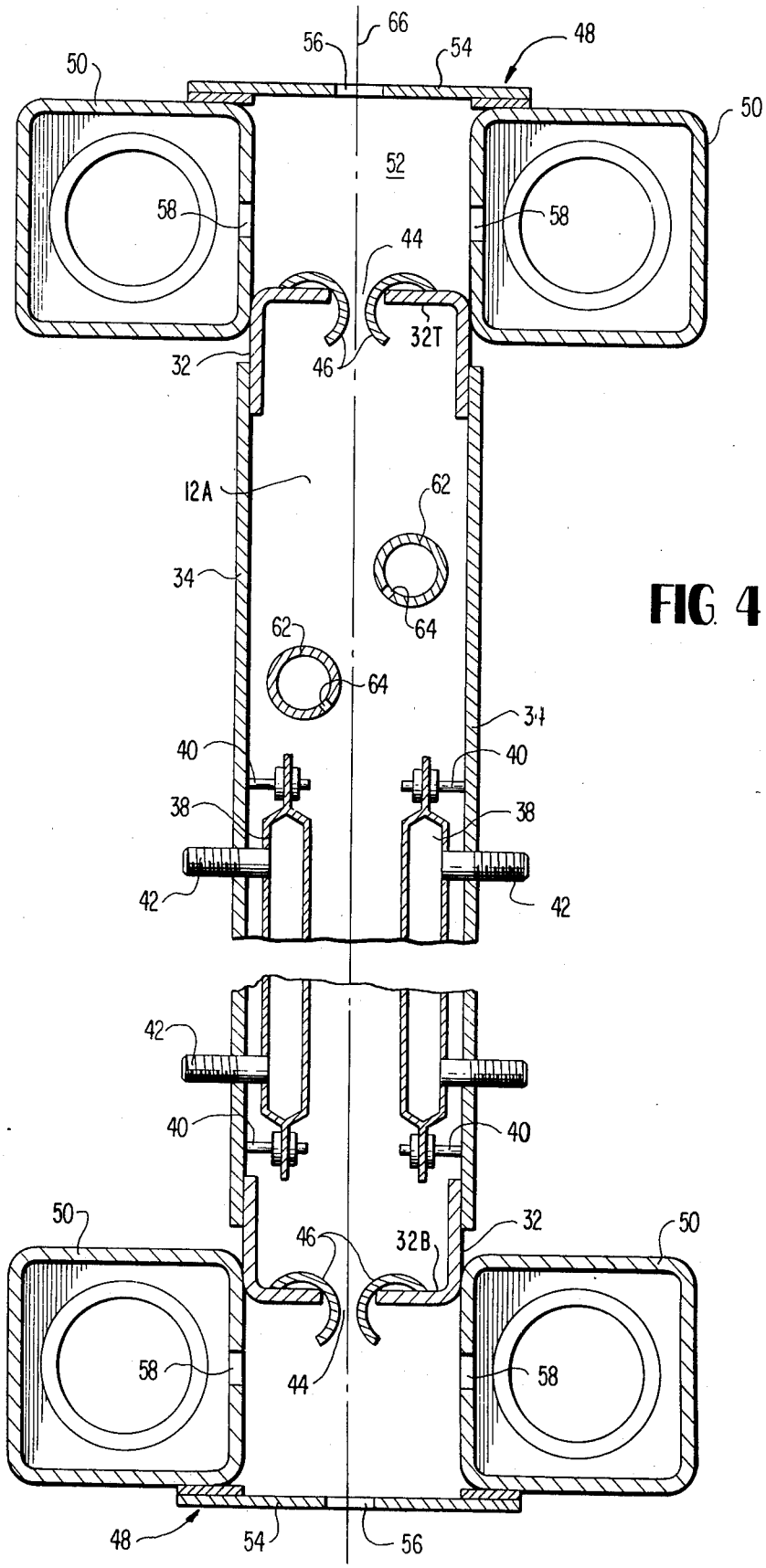
FIG. 4 is a cross-sectional view of the reaction chamber along the line 4—4 of FIG. 3.

The reaction chamber 12 is illustrated in FIGS. 2, 3, and 4. The reaction chamber 12 includes a treatment chamber 12A whose end walls 32E and top and bottom walls 32T, 32B are formed by a rectangular frame 32. Side panels or walls 34 are secured to the frame 32 and sealed against leakage around the edges of the panel. Brackets 36 may be provided on the frame for mounting the reaction chamber 12 in the enclosure 10.

Reaction chamber 12 includes one or more conduits or spray members which may be in the form of one or more pipes 62 extending the width of the reaction chamber 12 and preferably equidistantly disposed on opposite sides of the central plane 66 which passes midway between the panels 34. The plane coincides with the path of the fabric 14 as it passes through the reaction chamber 12. Each spray member has a series of regularly spaced openings 64 which form nozzles for directly the fluid out of the pipe into the reaction chamber. Preferably the nozzles are directed to discharge the fluid towards the central plane 66. The sleevelike chamber 12 and the spray members 62 are arranged to provide penetration of the fluid throughout the fabric as the fabric passes through the chamber. Penetration is provided by a number of factors including, for example, the relative thinness of the reaction chamber 12, the number and position of the nozzles and the velocity of the fluid exiting from the nozzles. The pipes are preferably horizontally movable so as to be adjustable with respect to their distance from the fabric and rotationably movable so as to be adjustable with respect to the angle of the nozzle relative to the fabric. The spray members can contain openings at various angles to the fabric.

Each panel 34 may have a thin plate heat exchanger 38 mounted on the interior wall by means of studs 40. The heat exchangers 38 are provided with pipe fittings 42 which extend through the panels 34 for conducting heat transfer fluid into and out of the heat exchangers 38. Preferably, each heat exchanger 38 also has a convoluted surface on at least the side adjacent the fabric sufficient to promote turbulent flow of a fluid along the fabric surface after the fluid has been introduced through openings 64. Such turbulent flow also provides penetration of the fluid throughout the web.

As shown in FIG. 4, the top and bottom of the frame 32 have slots 44 which extend from one end of the frame 32 to the other. The opposite edges of the slots 44 may be covered by lip member guide means which may be flexible, semicircular lengths of a suitable nonreactive material. Characteristically, lip members 46 are formed from plastic (e.g., polytetrafluoroethylene) tubing which has been cut in half and mounted on the top and bottom of the frame by means of screws or other suitable mounting means.

A wind box 48 is mounted over each of the slots 44 and is secured and sealed to the frame 32 such that the frame 32 defines a partition between the treatment chamber 12A and the wind box 48. Each wind box 48 includes a pair of plenum chambers 50 on opposite sides of the slot 44. Each plenum chamber 50 is coextensive with the width of the frame 32. An end plate 52 is secured between the plenum chambers 50 at opposite ends of the slot. A cover plate 54 is also mounted on each pair of plenum chambers 50 and extends the width of the chamber. The cover plate 54 and the end plates 52 and the opposite walls of the plenum chambers 50 cooperate to form an enclosure around the slot 44 at the top and the bottom of the frame 32. The cover plate 54 has a longitudinal slot 56 which is aligned with and substantially coextensive with the corresponding slot 44.

The plenum chambers 50 each contain exhaust apertures such as a plurality of holes 58 spaced apart at regular intervals along the length of the slot 44. The plenum chambers are each connected via exhaust pipe 60 to suitable exhaust means (not shown) such as a suction fan which provides a sufficient exhaust such that any gas or vapor leaking through the slots 44 will be effectively drawn out through the exhaust apertures 58 and will not enter the interior of the enclosure 10. Since the gas is withdrawn before it can enter the enclosure 10, it cannot leak from the enclosure into the area adjacent thereto. The reaction chamber 12 is maintained at a predetermined negative pressure relative to the pressure within the enclosure. Also, gas which may be in the enclosure 10 (e.g., air, steam) is withdrawn through exhaust apertures 58 before such gas can enter through slots 44 into the interior of the reaction chamber 12.

As noted before, reaction chamber 22 may be identically constructed as reaction chamber 12.

Although the fluid treatment apparatus of the present invention has been illustrated in FIG. 1 and the accompanying description as including two reaction chambers, it will be understood that other embodiments of the apparatus of the present invention may also include only one or more than two such reaction chambers.

Processing

The fluid treatment apparatus of the present invention is particularly well-suited for use in durably fixing a polymer former or a crosslinking agent in a cellulose fiber-containing fabric in a continuous manner. This fixation can make the fabric capable of developing durable press properties when subsequently dry cured, or, in the case of suitably chosen reaction system, the fixation itself can impart the desired durable press properties to the fabric.

In one embodiment of such a process, the fabric which is continuously advanced into the enclosure is a cellulose fiber-containing fabric which has been padded with an aqueous solution containing a latent curing catalyst and a water-soluble polymer forming material such as an aminoplast precondensate containing reactive N-methylol groups or a compound such as urea which forms a N-methylol precondensate upon reaction with formaldehyde. The padded fabric is exposed in the presence of moisture to formaldehyde and sulfur dioxide at a temperature sufficient to cause the N-methylol compound and formaldehyde to become durably fixed in the material in substantially water-insoluble form so as to be capable of causing the desired crosslinking during a final dry cure step.

The fabric may contain various natural or regenerated cellulose fibers alone or as mixtures with each other in various proportions or as mixtures with other fibers. They include natural cellulose fibers such as viscose rayon and cuprammonium rayon. Other fibers which may be used in blends with one or more of the above-mentioned cellulosic fibers are, for example, wool, silk, cellulose acetate, polyamides (e.g., nylon), polyesters (e.g., polyethylene terephthalate), acrylics, polyolefins (e.g., polypropylene), polyvinyl chloride, polyvinylidene chlorine, and polyvinyl alcohol fibers. Such blends may include at least 15 percent, desirable at least 35 percent, but most preferably at least 70 percent, of cotton or other natural cellulose fiber.

The material may be a knit, woven, nonwoven, or otherwise constructed fabric or the invention may be applied to fibers or yarns before they are converted into more complex structures. The web may be in flat, creased, pleated or hemmed from prior to treatment in the present invention and may be formed into virtually any shape after being wet fixed in accordance with the present invention. After complete processing, the formed creaseproofed fabric will maintain the desired configuration substantially for the life of the article, that is, a durable press fabric will be produced which will retain its desired shape through numerous wear-wash-dry cycles, requiring little or no pressing. The process may also be applied to paper to increase its wet strength and durability.

The preferred polymer forming N-methylol compounds at this time include the melamine-formaldehyde, urea-formaldehyde, and the phenol-formaldehyde precondensates.

The polymer formers useful herein include particularly the easily hardenable precondensates which are substantially water-soluble and are obtained by condensation of formaldehyde with a compound such as melamine or a $C_1$ to $C_4$ alkyl substituted melamine, a urea, or a hydroxy benzene such as phenol or resorcinol. The resulting methylol-containing compound or precondensate may further be etherified by reaction with a lower alkanol such as methanol or butanol. As is well-known in the fabric treating art, these precondensates are capable of being applied to the cellulosic material from an aqueous solution and to be readily wet fixed or insolubilized therein as described, for instance, in U.S. Pat. No. 3,138,802. Triazines obtained by condensing a methyl or other lower alkyl substituted melamine and formaldehyde are further examples of such precondensates.

Good results are obtained, for instance, using precondensates obtained by condensing 1 mole of melamine or an alkyl substituted melamine with 2 to 6 moles of formaldehyde, i.e., using di-, tri-, tetra-, penta-, or hexa-methylol melamine. Such products function well as polymer formers which can be readily wet fixed in the material by heating or steaming as described herein.

Commercially available products of this kind include Aerotex 23, an alkylated melamine-formaldehyde precondensate; Aerotex M-3, a dimethoxymethylhydroxymethyl-melamine; and Aerotex 19, which is a less completely fractionated modification of Aerotex P-225. These products are supplied in the form of aqueous solutions by American Cyanamid Company. Equivalent products are commercially available from other manufacturers.

The padding bath with which the fabric is contacted generally also contains a conventional latent curing catalyst which releases or acts as a strong acid upon heating to an elevated temperature such as 120°C. or higher. For example, one can use a water-soluble salt of a strong acid with a weak base such as an ammonium salt of hydrochloric, sulfuric, nitric, oxalic, lactic, or other inorganic or organic acid, various amine hydrochlorides, as well as acid acting salts of metals such as zinc or magnesium, e.g., zinc nitrate or magnesium chloride or a mixed catalyst such as $MgCl_2/ZnCl_2$, $MgCl_2$/cirtic acid or $Zn(NO_3)_2$/tartaric acid.

For example, when using conventional padding equipment, or when applying the chemicals by spraying or other known processes, the polymerizable N-methylol compound or precondensate may be dissolved in water to form a solution containing from about 3 to 25 percent, and preferably from about 5 to 15 percent, of the N-methylol compound. To facilitate its ultimate cure in the cellulosic material, a curing catalyst may be included in this same solution, or in a separate solution, in an amount of between about 1 and 10 percent, and preferably between about 4 and 6 percent, based on the weight of the N-methylol compound. As known to those skilled in the art, the optimum concentration depends somewhat on the particular catalyst and particular N-methylol compound used, and may be determined by routine preliminary tests.

Depending on the requirements of the finished materials or fabrics, the padding or impregnation is carried out in such a manner that the add-on of N-methylol compound deposited on the material is between about 3 to 12 percent, and preferably between about 6 to 8 percent, calculated as dry solid deposit based on the weight of dry fibrous material ("owf"). The padding is normally performed at ambient temperature, e.g., between about 10° and 30°C.

The aqueous padding bath may also contain other conventional fabric treating agent, for instance, wetting agents and fabric softeners, i.e., polymers capable of forming a soft film on the material or fabric. For example, suitable fabric softeners include a latex of fine aqueous dispersion of polyethylene, various alkyl acrylate polymers, acrylonitrile-butadiene copolymers, deacetylated ethylene-vinyl acetate copolymers, polyurethanes, and the like. Polymeric additives suitable for this general purpose are otherwise well-known in the art and in most cases are commercially available in concentrated aqueous latex form. For use in the present invention, such a dispersion is preferably diluted to provide about 0.1 to 4 percent of softener based on the weight of the fabric (owf).

After padding in the liquid bath containing the polymer former, it is generally useful to pass it between squeeze rolls where excess liquid is squeezed out.

The padded squeezed fabric enters the enclosure 10 at ambient temperature and is passed about guide rolls into and through a first reaction chamber 12. The enclosure 10 is maintained at a reduced pressure relative to amibient, such as, for example, about 0.1 to 1.0 inch water gauge below ambient. An acid such as sulfur dioxide gas is passed into the reaction chamber 12 and impinged through pipes 62 and openings 64 onto the continuously advancing fabric. Reaction chamber 12 further contains a thin-walled, convoluted surface heat exchange 38 through which cooling fluid is passed to maintain the fabric temperature at about ambient (e.g., from about 20° to about 50°C., preferably from about 25° to about 40°C.). Turbulence is promoted by the velocity of the fluid impinged through openings 64 and the convoluted surface enhances turbulent flow of the treating gas as it passes over the fabric thus promoting solid-vapor contact. As understood by those skilled in the art, laminar flow of a gas along a solid surface is generally accompanied by a boundary layer which retards contact of the vapor and the solid. Baffles or other turbulence promoting structures may also be utilized.

A negative pressure relative to the pressure within enclosure 10 of about 0.5 to about 1.0 inch water gauge, preferably from about 0.5 to about 0.8 mm. Hg., is created through exhaust pipe 60 to plenum chambers 50 at each end of the reaction chamber 12. In this manner, leakage of treating gas from the interior of reaction chamber 12 into the enclosure 10 is substantially prevented.

The fabric is continuously advanced from reaction chamber 12 about guide rolls 19 over five rotary drums 20 each heated to a temperature of about 75° to about 200°C., preferably from about 80° to about 180°C., to heat the fabric rapidly to the desired temperature with a minimum loss of moisture.

The heated fabric is continuously advanced over guide roller 24 into and through a second reaction chamber 22. Formaldehyde vapor is impinged onto the fabric at a temperature of about 100° to about 200°C., preferably from about 120° to about 180°C. Heated fluid may be passed through a thin plate, convoluted surface heat exchanger of the same construction as in reaction chamber 12 to maintain the desired temperature within the interior of the reaction chamber 22 as well as to promote vapor-solid contact.

As understood by those skilled in the art, and as more fully explained in U.S. Pat. No. 3,642,428, herein incorporated by reference, the moisture content of the fabric in the second reaction chamber is important and is maintained between about 15 and about 90, preferably between about 30 and about 70 percent by weight of the fabric. The moisture content is important as waters reacts with the $SO_2$ and formaldehyde to form a strong acid catalyst in situ on the fabric in accordance with the following reversible equation:

$$CH_2O + SO_2 + H_2O \rightleftarrows HOCH_2{\cdot}SO_3H$$

This strong acid catalyst fixes the polymer in the fibers of the fabric, and can then be decomposed by simple drying.

Again, a reduced pressure of the same magnitude as applied to the plenum chambers of reaction chamber 12 is applied to the plenum chambers of the second reaction chamber 22 to prevent the leakage of any substantial amount of vapors from the interior of the reaction chamber 22 into the enclosure 10.

After leaving the second reaction chamber 22, the fabric may be continuously advanced about a plurality of guide rolls 26 in the holding area of the enclosure 10 for a time and at a temperature sufficient to essentially complete the polymerization and fixation of the polymer former in the fabric.

The fabric is removed from the enclosure 10 and may be further processed to form a durable press article. After exposure to the reactive atmosphere in the second reaction chamber, if the initial pad bath contained a latent curing catalyst, the cellulosic material is directly dried in preparation for the manufacture of a durable press article therefrom. No other intervening rinsing or other processing is required in such a case. Only if a latent catalyst was not included in the initial pad bath is it necessary to pass the fabric after the vapor treatment and before the drying step through a second pad bath containing an aqueous solution of a suitable latent curing catalyst, whereby the fabric becomes catalyzed for the eventual dry cure. Drying conditions are not especially criticial, but if delayed cure properties are desired, drying should be controlled to avoid precuring.

In a specific embodiment of the invention, a continuous length of a 100 percent cotton fabric is padded with an aqueous solution of 12 percent of hexakis (methoxymethyl) melamine precondensate, 0.5 percent zinc nitrate hexahydrate, 0.2 percent "Triton X-100" nonionic wetting agent and 1.0 percent finely dispersed polyethylene fabric softener ("Velvamine 732").

After squeezing out excess liquid to a 65 percent wet pick-up by passage through a pair of squeeze rolls, the fabric is continuously advanced into the enclosure 10 as shown in FIG. 1.

The fabric is continuously advanced into the first steel reaction chamber which is wider than the fabric width, long enough to provide sufficient contact area between the fluid and fabric and sufficiently shallow (e.g., about 6 inches or less) or promote penetration of the fluid throughout the fabric. The reaction chamber also includes a slot on its top and bottom extending substantially the width of the reaction chamber.

A wind box is attached to each end of the reaction chamber and also is formed of steel. Each box contains a slot in alignment with the corresponding slot in the reaction chamber. Each wind box plenum chamber further includes a plurality of holes arranged symmetrically and equidistant along the length of the slot. One end of each wind box plenum chamber is provided with a suitable pipe connection to a suction fan to establish a reduced pressure in the plenum chamber of about 0.5 inch water gauge below the pressure in the enclosure 10.

The reaction chamber further includes a pair of spray members formed of pipe, each containing a plurality of small diameter holes spaced equidistantly over the pipe length. The reaction chamber also includes a convoluted surface thin plate heat exchanger on either side of the fabric with suitable connections to a cooling fluid source.

Sulfur dioxide gas is passed into the spray pipes and is impinged on the fabric continuously advancing therethrough while sufficient water is passed through the heat exchangers to maintain the fabric temperature at about 25°C.

The fabric is continuously advanced from the first reaction chamber about five rotary drums which may be independently heated to temperatures ranging from 75° to 200°C. by steam in the interior of the drums.

The fabric, at the desired temperature, is passed into a second reaction chamber constructed in the same manner as the first reaction chamber, where formaldehyde vapor is impinged on the fabric. Steam is passed through the heat exchangers to maintain a temperature in the reaction chamber of about 150°C. The fabric has a moisture content of about 50 percent ("owf") to polymerize the resin and cause it and the formaldehyde to become fixed in the fabric, leaving the fabric capable of being crosslinked in a subsequent dry cure step.

The treated fabric leaves the second reaction chamber and is guided about the holding area a time sufficient to complete fixation of the resin and formaldehyde in the fabric. During this time, which may be about one minute or less, the heat exchangers maintain a temperature of about 85°C. The resulting fabric leaving the enclosure has a moisture content of about 45 percent and may be dried. The dried fabric is subsequently dry cured to provide a durable press article. It will be understood that the fluid treatment and arrangement described above may be modified in various ways. For example, the padded, squeezed fabric may be passed into the enclosure 10 and directly about a plurality of heated drums 20 to raise the temperature of the fabric up to about 100°C. The heated fabric may then be passed into the reaction chamber 22 in which a mixture of formaldehyde and $SO_2$ is impinged upon the fabric at a reaction chamber temperature of from about 75° to about 175°C., preferably from about 90° about 150°C. and a moisture content of about 15 to about 90, preferably from about 30 to about 70, percent by weight of the fabric.

In another embodiment, when a highly methylolated polymer former is used, such a compound may, in and of itself, furnish sufficient formaldehyde to form the required amount of sulfonic acid catalyst and assist in the fixation of formaldehyde in the fabric, and in such a case only a single reaction chamber with proper moisture control is necessary.

Also, the holding portion of the enclosure may be omitted, if desired.

The apparatus of the present invention is also useful in a process such as that disclosed in previously mentioned U.S. Pat. No. 3,706,526 in which an unpadded cotton-containing fabric is contacted with hot formaldehyde and $SO_2$ in the presence of moisture to form the highly acid sulfonic acid catalyst as explained above and cause the formaldehyde to crosslink the cellulose fibers. The fabric may be heated by passage about a plurality of rotary heated drums and passed into a single reaction chamber into which formaldehyde, $SO_2$ and steam are injected either as a mixture or separately. Alternatively, the fabric may be passed into the first reaction chamber where it is contacted with a formaldehyde-sulfur dioxide mixture and then passed over the rotary drums into a second reaction chamber where it is heated while controlling the moisture content of the fabric to produce the desired reaction.

This apparatus is similarly useful in a process for imparting durable press properties to a fabric in the presence of a gaseous catalyst, such as, for example, passing a cellulose fiber-containing fabric padded with an aqueous solution of a water-soluble creaseproofing agent containing reactive N-methylol groups over the heated rotary drums to a temperature of between above 80° up to about 160°C. and passing the fabric into a reaction chamber containing a vapor atmosphere containing a formic acid or acetic acid catalyst to effectively crosslink the cellulose fibers. The crosslinked fabric may be further heated in the enclosure to a temperature above about 100°C. to dissipate water vapor, residual catalyst and unbound creaseproofing agent and to cure the crosslinked fabric.

The apparatus of the present invention may be utilized in a process for imparting flameproofing properties to cellulose fiber-containing fabrics in which, for example, the fabric is padded with an aqueous solution of a phosphorus-containing monomeric material which reacts with ammonia to form a water-insoluble polymer within the fabric and fiber such as monomeric tris (hydroxymethyl) phosphonium hydroxide and dried to a wet pick-up of about 12 to 15 percent. The fabric is then passed into the enclosure 10' shown in FIG. 5 in which those elements similar to those shown in FIGS. 1 to 4 are indicated in prime numerals corresponding to the same numerals in the other drawings.

As illustrated therein, the dried, padded fabric 14' enters the enclosure 10' through horizontal slot 16' about guide roll 18' and through a first reaction chamber 12' (FIG. 6) in which ammonia gas is impinged onto the fabric at about ambient temperature (e.g., about 20°C.). The reaction chamber 12' utilized in this embodiment of the fluid treatment apparatus of the present invention is similar to reaction chamber 12 described above and those elements indicated in prime numerals correspond to the same numerals in the other drawings. In this particular embodiment, the heat exchanger means 38 and attendant components may be omitted. A second pair of pipes 62' may be disposed within the reaction chamber to provide further gas flow. In the preferred embodiment illustrated in FIG. 6, the pipes 62 each contain spaced openings 64' and 64'' at two different angles to the fabric. In this manner, fabric-vapor contact may be optimized.

The reaction chamber 12' may also contain a fabric-vapor contact enhancer generally indicated as 90'. The enhancer is adapted to contact the fabric as it passes through the reaction chamber 12' and includes a contact area 91' including a series of perforations 92' or a longitudinal slot or equivalent. The fabric-vapor enhancer is connected by suitable pipe (not shown) to suitable exhaust means which provides a sufficient exhaust such that the atmosphere in the reaction chamber 12' will be drawn through the fabric as it is passing over the enhancer 90' and through perforations 92'. The removed atmosphere may be recycled back into the reactor through pipes 62' by suitable means (not shown). In this manner, contact of the ammonia gas with the internal portions of the fabric and formation therein of the polymerized phosphorus-containing material may be enhanced.

The fabric exits the first reaction chamber 12', passes over guide roll 18' and passes through a second reaction chamber 12' (constructed in the same manner as the first reaction chamber 12') in which ammonia gas is also impinged at about ambient temperature. In these reaction chambers, the ammonia gas deposits within the fiber and fabric a polymerized phosphorus-containing material. The fabric is thereafter passed over a plurality of guide rolls 26'. A liquid such as water is sprayed onto the fabric through one or more sprays 80' to wash the fabric and remove unpolymerized materials therefrom. A spray catch pan 82' or equivalent construction may be disposed in the bottom of enclosure 10' to collect and remove the spray run-off from the fabric. The fabric may thereafter be removed through horizontal slot 27' for further processing.

Sufficient polymerized phosphorus-containing material may be developed within a single reaction chamber to provide for the omission of the second reaction chamber. Alternatively, in this circumstance, the second reaction chamber may be utilized to spray water onto the fabric to remove unpolymerized material and residual reactants. In the latter situation, the separate washing area may be omitted.

Figure 5:
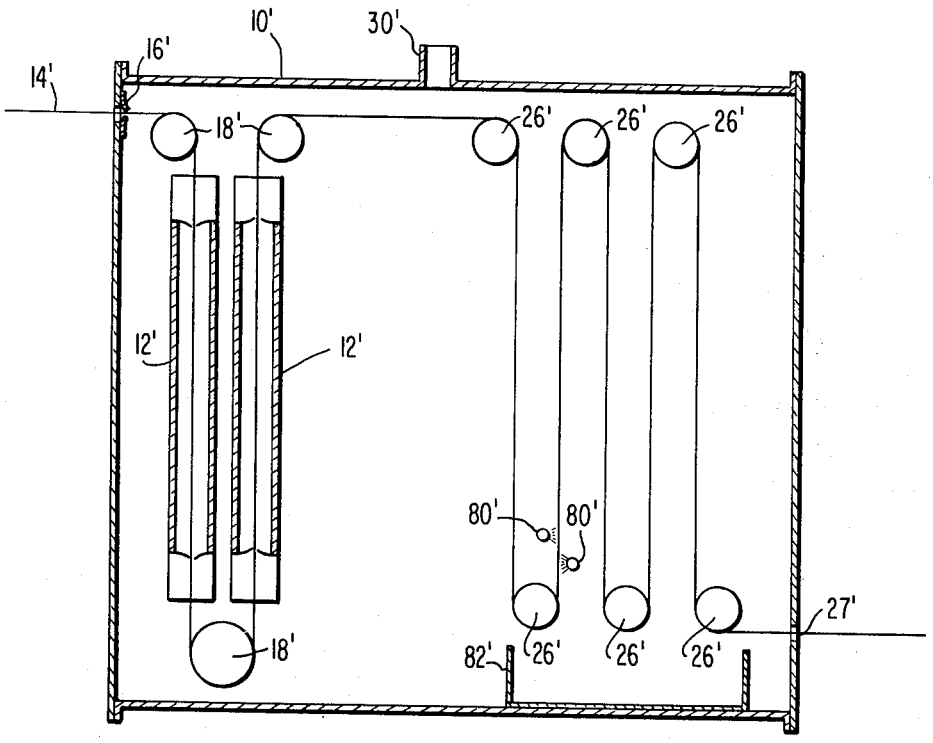
FIG. 5 is a side elevational view, partly schematic of another embodiment of the fluid treatment apparatus particularly useful in forming flame retardant fabrics.

In a specific embodiment of the invention relating to imparting flameproofing properties, a continuous length of a 100 percent cotton fabric is padded with an aqueous solution having a pH of about 7.0 and containing 25 percent of an equilibrium mixture of monomeric tris (hydroxymethyl) phosphine and monomeric tris (hydroxymethyl) phosphonium hydroxide to a wet pick-up of about 80 percent dried at 50°C. to a wet pick-up of 14 percent and continuously advanced into the enclosure 10' as shown in FIG. 5.

Figure 6:
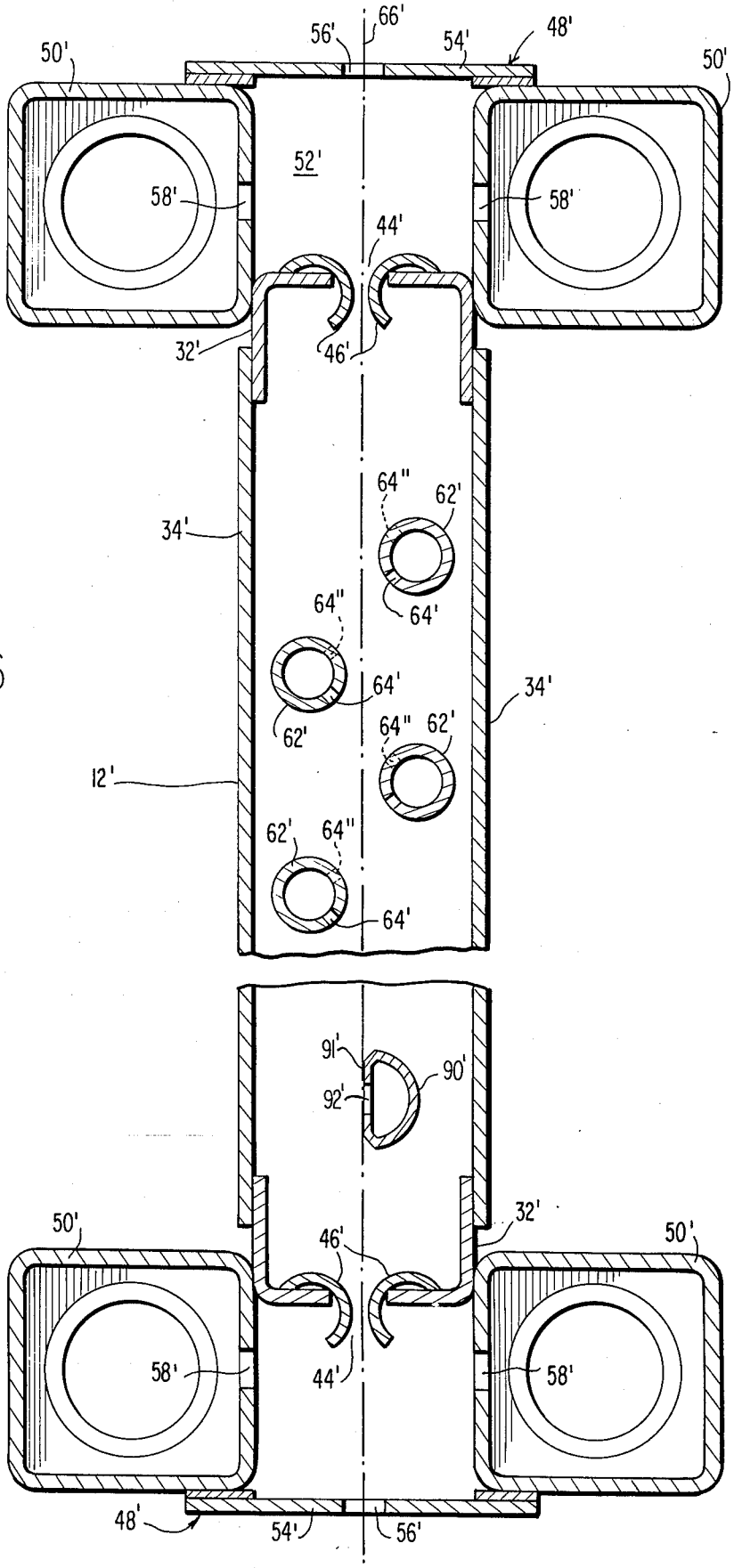
FIG. 6 is a cross-sectional view of another embodiment of a reaction chamber of the present invention particularly useful in the fluid treatment apparatus of FIG. 5.

The fabric is continuously advanced into the first reaction chamber 12' of FIG. 6. Ammonia gas is passed into the spray pipes in the reaction chamber 12' and is impinged at ambient temperature (about 20°C.) on the fabric continuously advancing therethrough.

The fabric is continuously advanced from the first reaction chamber about guide roll 18' and into second reaction chamber 12' constructed similarly to the first reaction chamber and in which ammonia gas is also impinged on the fabric at ambient temperature. A polymerized phosphorus-containing material is deposited on and within the fabric in the two reaction chambers.

The fabric is guided about a series of six spaced guide rollers 26', three of the guide rolls located near the top of the enclosure and three located near the bottom. A pair of water spray nozzles 80' are disposed among the guide rollers to spray ambient temperature water uniformly on both sides of the fabric to remove unpolymerized materials and residual reactants. The spray water running off of the fabric is collected in a catch pan 82' at the bottom of the enclosure and removed. The fabric is continuously removed from the enclosure 10' for further processing including washing and passing the fabric through a hydrogen peroxide-containing bath to oxidize the polymerized material.

While the foregoing specification describes the general principles and nature as well as preferred embodiments and modifications of the present invention, still other modifications may be made by those skilled in the art without departing from the scope and spirit of the appended claims.

All parts, proportions and/or percentages referred to in the present specification and claims are by weight unless otherwise indicated.

What is claimed is:

1. Apparatus for treating a continuously advancing web of material with a fluid comprising:

sleeve-like reaction chamber means having an entrance opening and exit opening;

a pair of partitions in said chamber means, one of said partitions being adjacent said entrance opening and the other of said partitions being adjacent said exit opening, said partitions having inlet and outlet openings aligned with said entrance and exit openings;

a pair of end walls and a pair of side walls interconnecting said partitions to define a fluid treatment chamber within said sleeve-like reaction chamber means for receiving a web of material traveling along a path from said inlet opening to said outlet opening;

each side wall having a dimension extending perpendicular to the direction of travel of said web and defining a length of said treatment chamber;

each end wall having a dimension extending perpendicular to the direction of travel of said web and defining a width of said treatment chamber;

said length having an extent which is multiple times the extent of said width;

a plurality of pipes for conducting pressurized fluid into said treatment chamber, said pipes each projecting through one of said walls and into said treatment chamber and extending parallel to the length of said treatment chamber spaced inwardly from said side walls and on opposite sides of said travel path of said web;

said pipes each including fluid discharge openings spaced therealong and being directed toward said travel path of said web so as to direct fluid toward a web traveling through said treatment chamber and to provide penetration of the fluid throughout the web during travel of the web through said treatment chamber; and evacuation means for withdrawing fluid from said treatment chamber between said entrance opening and said one partition and from between said exit opening and said other partition;

said evacuation means being arranged to allow material to enter and exit said sleeve-like chamber means without there occuring substantial leakage of gases from said sleeve-like chamber means.

2. Apparatus according to claim 1 wherein said pipes extend through an end wall of said treatment chamber.

3. Apparatus according to claim 1 including treatment enhancer means; said treatment enhancer means comprising exhaust means disposed interiorly of said treatment chamber means between said inlet and outlet openings and adjacent one side of the path of travel of the web of material to draw fluid from within said treatment chamber and through said web of material to enhance the application of fluid thereto.

4. The apparatus according to claim 1 including heat exchange means in said treatment chamber on opposite sides of said travel path.

5. The apparatus according to claim 4 wherein said side walls extend substantially vertically between said partitions, said heat exchange means extending generally vertically along said side walls with the heat exchange means having a generally convoluted surface; and conduits for directing heated gas into and out of said heat exchange means.

* * * * *